US006076346A

United States Patent [19]

Nakayama et al.

[11] Patent Number: 6,076,346

[45] Date of Patent: Jun. 20, 2000

[54] TWISTING APPARATUS

[75] Inventors: Teruo Nakayama, Otsu; Yoshihisa Inoue, Ibaraki, both of Japan

[73] Assignee: Murata Kikai Kabushiki Kaisha, Kyoto, Japan

[21] Appl. No.: 09/153,461

[22] Filed: Sep. 15, 1998

[30] Foreign Application Priority Data

Sep. 29, 1997 [JP] Japan ..... 9-281324
Sep. 29, 1997 [JP] Japan ..... 9-281327

[51] Int. Cl.[7] ..... D01H 1/24

[52] U.S. Cl. ..... 57/335; 57/315; 57/328; 57/331; 57/334; 57/336

[58] Field of Search ..... 57/334, 335, 336, 57/315, 328, 331, 332

[56] References Cited

U.S. PATENT DOCUMENTS 4,372,109 2/1983 Farnhill et al. ..... 57/401
5,094,068 3/1992 Hirao ..... 57/336
5,136,835 8/1992 Hirao ..... 57/285
5,551,225 9/1996 Maruki et al. ..... 57/328
5,699,661 12/1997 Maruki ..... 57/335

FOREIGN PATENT DOCUMENTS 6-85374 12/1994 Japan .
7-48725 2/1995 Japan .

*Primary Examiner*—William Stryjewski
*Attorney, Agent, or Firm*—Armstrong, Westerman, Hattori, McLeland & Naughton

[57] ABSTRACT

To provide a twisting apparatus in which one of a pair of twisting rollers t1 and t2 is a hollow rubber roller t1, while the other is a hard cylindrical roller t2 in which a rubber band t16 is installed. Twisting efficiency is improved compared to the conventional twisting roller both comprising hollow rubber rollers. Thus, by applying the present invention to a spinning apparatus for manufacturing spun yarn from a fiber set, the spinning speed of the spun yarn can be increased and the spinning range extended.

6 Claims, 5 Drawing Sheets

TWISTING APPARATUS

FIELD OF THE INVENTION

The present invention relates to a twisting apparatus for twisting a fiber set, such as slivers comprising staple fibers or a bundle of filaments.

BACKGROUND OF THE INVENTION

In a conventional twisting apparatus, a pair of hollow rubber rollers are disposed so that rotating shafts of the hollow rubber rollers cross each other in such a way as to form a contact region in the large-diameter regions located in their approximate center, and within this contact region, a fiber set is gripped and twisted.

The conventional twisting apparatus described above grips a fiber set using a pair of deformable soft hollow rubber rollers. Thus, it effects only a weak force in gripping the fiber set, so its twisting efficiency is low.

Due to its use of a pair of deformable soft hollow rubber rollers, the conventional twisting apparatus effects only weak contact pressure on the contact region and thus cannot efficiently twist the yarn.

Furthermore, the conventional twisting apparatus produces mutual contact between the deformable soft hollow rubber rollers and rotates them relative to each other, so they are likely to become worn and require frequent maintenance.

It is an object of the present invention to solve these problems of the conventional twisting apparatus.

SUMMARY OF THE INVENTION

To achieve this object, the present invention provides a twisting apparatus wherein one of a pair of twisting rollers is a hollow rubber roller while the other is a hard cylindrical roller in which a rubber band is installed. Second, rubber bands of various thicknesses are detachably configured without changing the mounting positions of the twisting rollers. Third, circumferential grooves are formed in cylindrical middle regions located on the respective sides of the rubber band on the hard cylindrical roller.

DETAILED DESCRIPTION OF THE PREFERRED EMBODIMENTS

A twisting apparatus according to the present invention is described below using an example in which a fiber set comprising staple fibers is drafted by a draft apparatus and in which the staple fibers comprising the fiber set are then twisted to manufacture spun yarn.

First, a spinning apparatus is described as an example of a twisting apparatus to which the present invention is applied.

Figure 1:
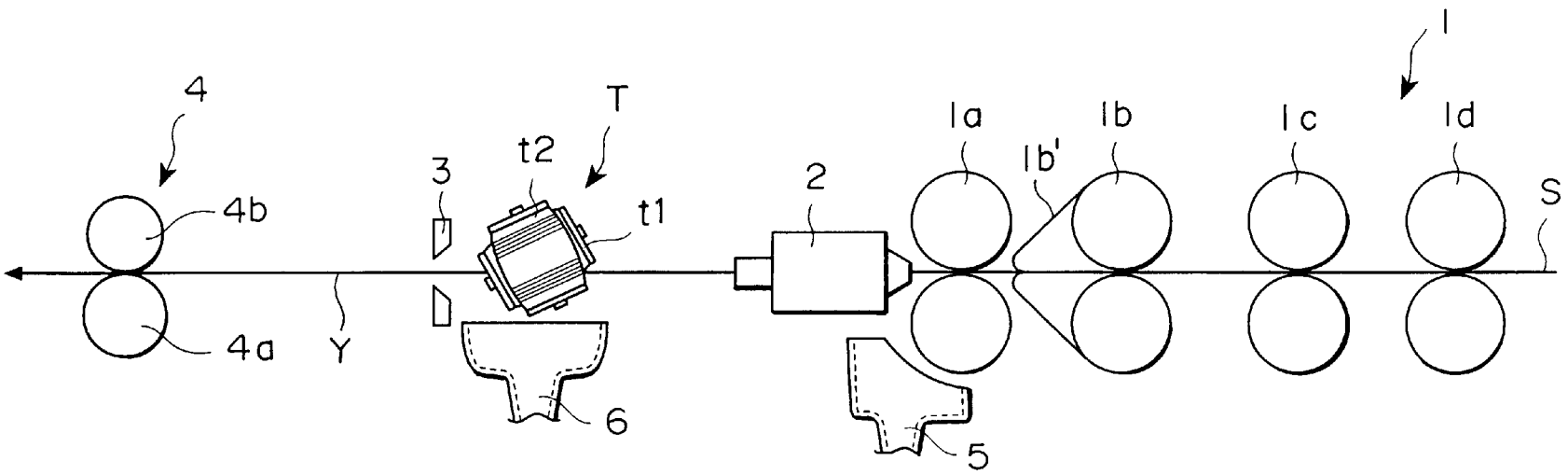
FIG. 1 is a schematic side view of a spinning apparatus to which, as an example, a twisting apparatus according to the present invention is applied.
Figure 2:
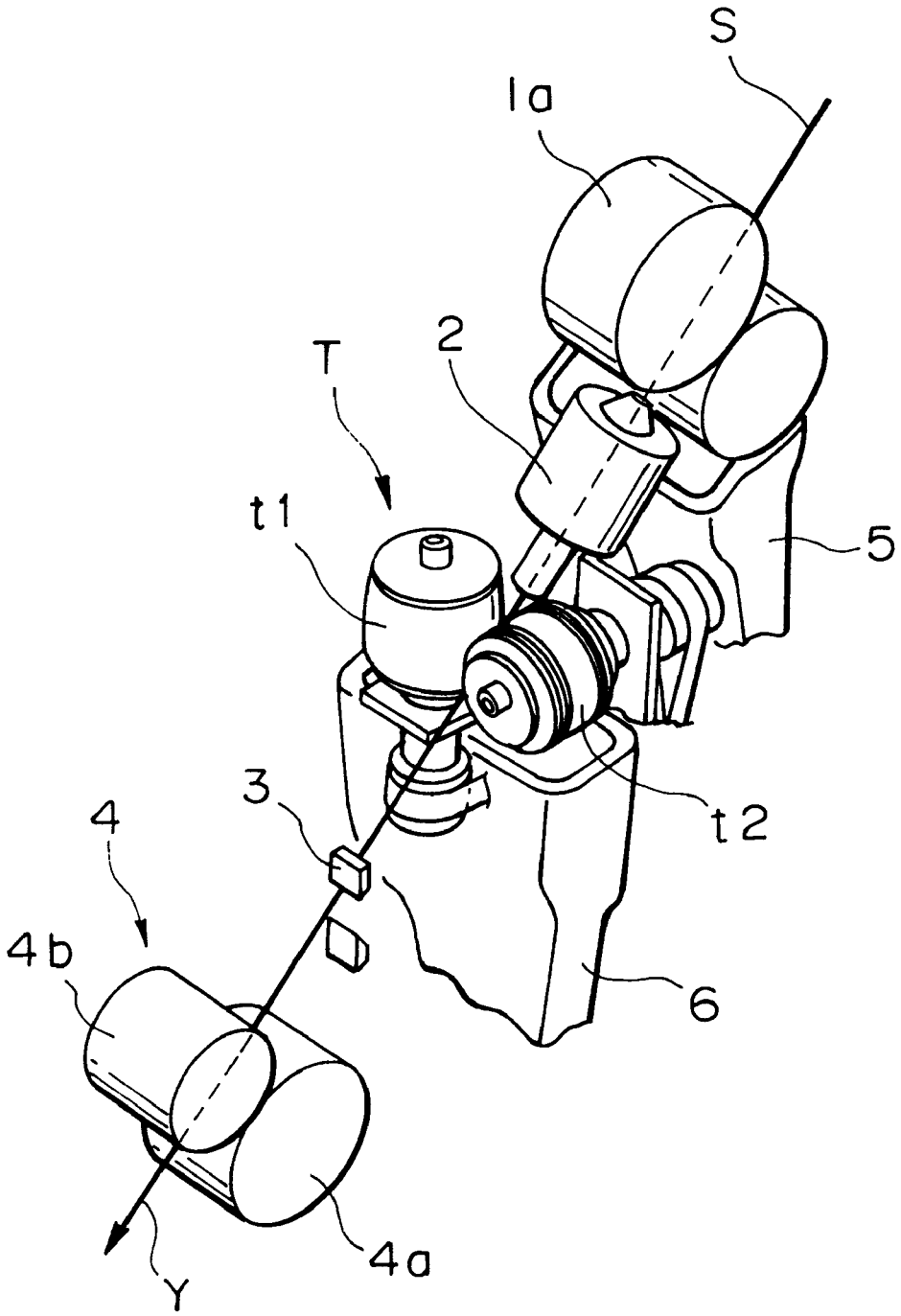
FIG. 2 is a partial perspective view of the spinning apparatus of FIG. 1 to which, as an example, the twisting apparatus according to the present invention is applied.

Numeral 1 indicates a four-line draft apparatus shown as an example and composed of a front roller 1*a*, a second roller 1*b* having an apron 1*b'*, a third roller 1*c* and a back roller 1*d*. Numeral 2 indicates a spinning nozzle located on the downstream side of the draft apparatus 1 (the travelling direction of a fiber set, i.e., left in FIG. 1 is defined as the downstream side) to generate a swirling air current and T is a twisting apparatus located on the downstream side of the spinning nozzle 2 and having a pair of twisting rollers t1 and t2 which are described below. Numeral 3 indicates a cutter disposed on the downstream side of the twisting apparatus T to operate in response to an instruction from a slab catcher (not shown in the drawing). Numeral 4 indicates a feeding apparatus located on the downstream side of the cutter 3 and comprising a delivery roller 4*a* that is constantly rotationally driven and a nip roller 4*b* that can contact and leave the delivery roller 4*a*. Numeral 5 indicates a dust box disposed below the front roller 1*a* and the spinning nozzle 2 to suck and remove fibers floating near the front roller 1*a* and the spinning nozzle 2.

Numeral 6 indicates a dust box disposed below the twisting apparatus T. In response to an instruction from the slab catcher, the cutter 3 operates to cut spun yarn while stopping the third roller 1*c* and the back roller 1*d* to stop the supply of a fiber set S, and the fiber set S is cut between the stopped third roller 1*c* and the constantly rotating second roller 1*b*. Since the spinning nozzle 2 and the twisting apparatus T continue operation until the end of that fiber set arrives, which is supplied from the constantly rotating front 1*a* and second rollers 1*b* and which has been cut on its third-roller 1*c* side, spun yarn is still spun out.

The dust box 6 is disposed below the twisting apparatus T to suck and remove such spun yarn.

The fibers constituting the fiber set S drafted by the draft apparatus 1 are introduced into the twisting apparatus T via the spinning nozzle 2, and most of them are twisted between the twisting apparatus T and a nip point of the front roller 1*a* and then are converged into core fibers. On the other hand, due to the spinning nozzle 2 generating a swirling air current in a direction opposite to the twisting direction of the twisting apparatus T, the remaining fibers that have not been twisted or used as core fibers are wound round the core fibers as wound fibers. These wound fibers are wound in a direction opposite to the twisting direction used for the core fibers. Subsequently, the twisting force applied to the core fibers by the twisting apparatus T starts to be released once the yarn has passed through the twisting apparatus T. When the core fibers are released, the releasing force effected in the same direction as the wound fiber's twisting direction causes the wound fibers wound to wind more tightly round the core fibers, thereby producing a kind of Fastened spun yarn Y in which the wound fibers are wound around core fibers on which almost no twisting force is now effected.

The twisting apparatus T according to the present invention having the pair of twisting rollers t1 and t2 is described.

Figure 3:
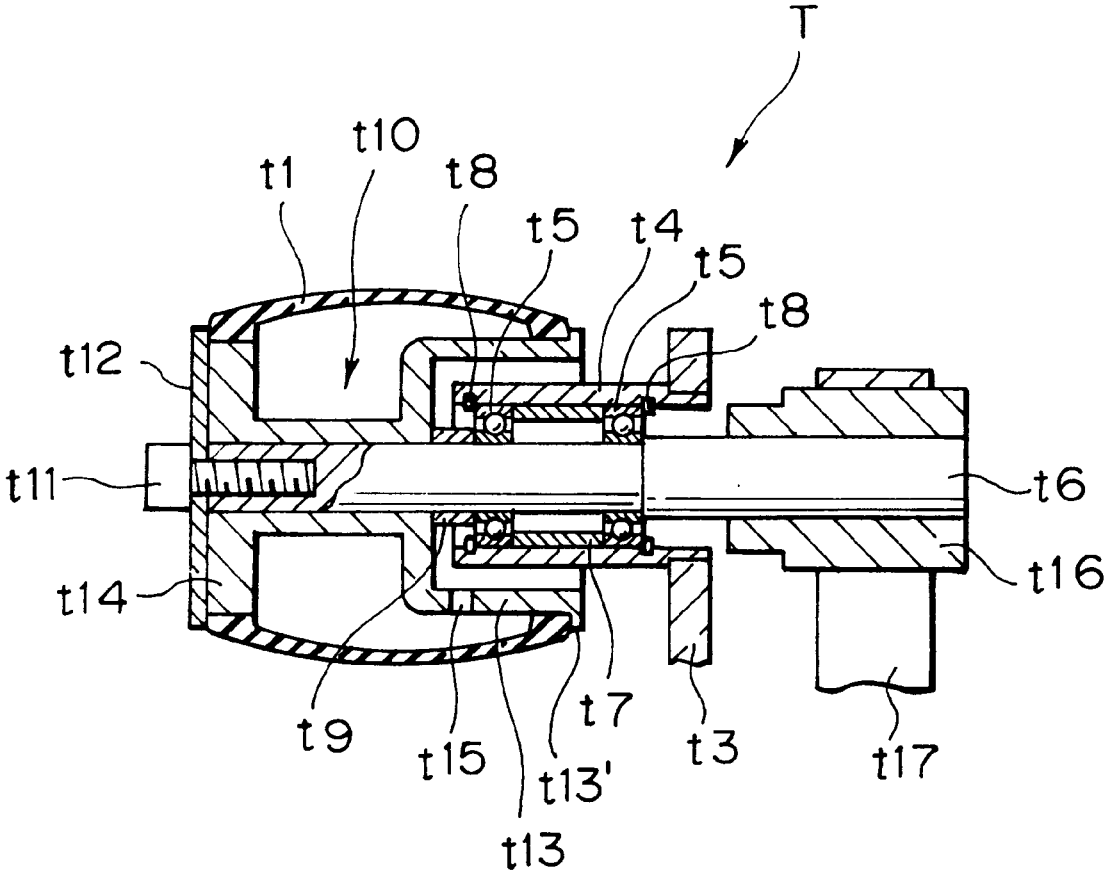
FIG. 3 is a vertical sectional view of one of two twisting rollers comprising the twisting apparatus according to the present invention.

One t1 of the rollers constituting the twisting apparatus T is formed as an appropriately soft and elastic hollow rubber, as shown in FIG. 3. By way of example, a support and a drive means for the hollow rubber roller t1 are described below.

A rotating shaft t6 is supported by a boss t4 fixed to a vertical frame t3 via bearings t5. The two bearings t5 are fixed by a spacer t7 installed therebetween and a stop ring t8 installed outside the respective bearings t5. A holding member t10 installed via the spacer t9 is fixed to the rotating shaft t6 at a predetermined position using a bolt t11 and a flange t12. When one of the ends of the hollow rubber roller t1 is pushed until it abuts an edge t13' of a cylindrical collar portion t13 of the holding member t10, the other end of the hollow rubber roller t1 is installed on a planar collar portion t14 of the holding member t10, and the holding member t10 is fixed by the bolt t11 and the flange t12 having a slightly larger outer diameter than the planar collar portion t14, while simultaneously the hollow rubber roller t1 is fixed to the holding member t10. That is, to replace the hollow rubber roller t1, only the bolt t11 and the flange t12 must be removed. In addition, a small hole t15 is provided in the holding member t10 to allow air to pass through. Reference character t16 indicates is a pulley installed at the end of the rotating shaft t6 opposite to the end on which the hollow rubber roller t1 is installed. Drive force is transmitted via a belt t17 extending around the pulley t16 to rotate the rotating shaft t6 in order to rotate the hollow rubber roller t1.

Figure 4:
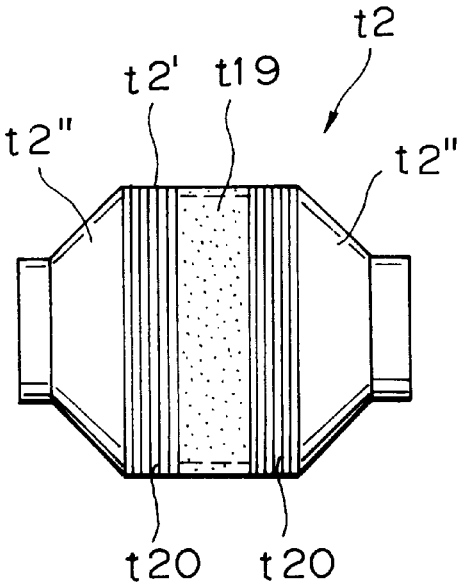
FIG. 4 is a front view of the other twisting roller constituting the twisting apparatus according to the present invention.
Figure 5:
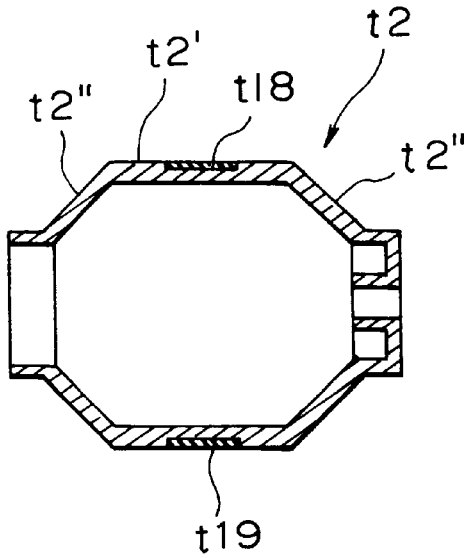
FIG. 5 is a vertical sectional view of the twisting roller shown in FIG. 4.
Figure 6:
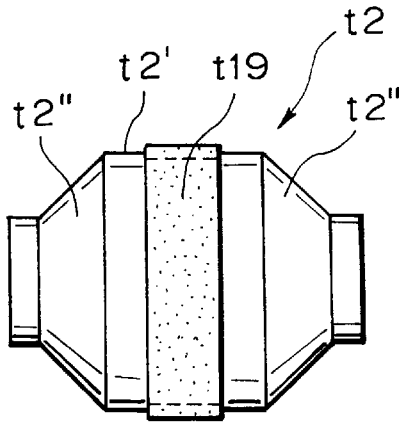
FIG. 6 is a front view of another embodiment of the other twisting roller constituting the twisting apparatus according to the present invention.

The other twisting roller t2 constituting the twisting apparatus T of the present invention is formed as a cylindrical roller t2 having cylindrical middle regions t2' and conical regions t2" tapered tilted from the respective ends of the cylindrical middle regions t2', like a truncated cone, and formed of a hard material, such as metal, ceramics or hard synthetic resin, and a recessed portion t18 is formed between the cylindrical middle regions t2' throughout the circumference, as shown in FIGS. 4 and 5. A continuous rubber band t19 is installed in the recessed portion t18. This rubber band t19 installed in the recessed portion 18 may be flush with the cylindrical middle regions t2', or it may have a thickness larger than the depth of the recessed portion t18 so as to protrude from the cylindrical middle regions t2'. In addition, the cylindrical middle regions t2' located on the respective sides of the rubber band t19 installed in the recessed portion t18 may be formed into a smooth surface or narrow circumferential grooves may be formed in these regions. A support and a drive means for the hard cylindrical roller t2 are substantially the same as those for the hollow rubber roller t1, so a description of these items is omitted.

According to the present invention, as described above, one of the twisting rollers t1 and t2, the rotating shafts of which cross each other and which are disposed in such a way as to form a contact region in the large-diameter regions located in their approximate center, comprises the hollow rubber roller t1, the other twisting roller comprises the hard cylindrical roller t2 having the rubber band t19 installed in the recessed portion t18 formed in the cylindrical middle regions t2'.

Experiments show that if P/C 65/35 (blended yarn comprising 65% of polyester and 35% of cotton) is used to manufacture spun yarn of thickness Ne 50 at a spinning speed of 350 m/min, the spinning rate of the twisting rollers comprising the conventional rubber rollers is 3,250 to 3,353 rpm, whereas that of the twisting rollers of the present invention is 3,223 to 3,423 rpm. That is, the conventional twisting rollers have a spinning range of about 100 rpm, whereas the twisting rollers of the present invention have a spinning range of about 200 rpm. Due to its high twisting efficiency, the present invention can set a lower limit on rotation rate than can a conventional apparatus. In addition, the present invention can also set a higher upper limit on rotation rate than a conventional apparatus due to its stable twisting effect.

As described above, by combining the hollow rubber roller t1 and the hard cylindrical roller t2 in which the rubber band 19 is installed in order to constitute the twisting apparatus T, the twisting efficiency is improved compared to the conventional twisting apparatus in which both twisting rollers are hollow rubber rollers. Thus, by applying the present invention to the above spinning apparatus for manufacturing the spun yarn Y from the fiber set S, the spinning speed of the spun yarn can be increased and the spinning range extended.

In addition, since one of the twisting rollers is the hard cylindrical roller t2, spinning can be achieved even if the cross angle between the twisting rollers t1 and t2 is varied distinctly, thereby extending the range of spinning conditions from that available when using conventional twisting rollers both comprising hollow rubber rollers. Accordingly, the present invention can deal easily with various fiber sets of different materials, fiber lengths or thicknesses and can also cope with various spinning conditions.

Furthermore, since one of the twisting rollers is the hard cylindrical roller t2, the contact pressure on the contact region is further stabilized to enable the fiber set S to be twisted stably. Thus, by applying the present invention to the above spinning apparatus for manufacturing the spun yarn Y from the fiber set S, the spinning speed of the spun yarn Y can be increased and spun yarn of stable quality can be manufactured.

Experiments show that if P/C 65/35 (blended yarn comprising 65% of polyester and 35% of cotton) is used to manufacture spun yarn of thickness Ne 50 at a spinning speed of 350 m/min., the average strength of spun yarn manufactured by the conventional apparatus is 197 gram, whereas that of yarn manufactured by the apparatus of the present invention is 206 gram, a 5% rise.

Furthermore, since one of the rollers is the hard cylindrical roller t2, it minimizes the need for replacements resulting from abrasion. In addition, the present invention reduces slippage and thus reduces abrasion of the hollow rubber roller t1, compared to the conventional twisting rollers both comprising hollow rubber rollers.

The hollow rubber roller in the conventional apparatus must be replaced in three weeks, whereas the present invention does not require the hollow rubber roller to be replaced until five weeks have passed, thereby substantially increasing the lifetime of the roller.

The cylindrical middle regions t2' located on the respective sides of the rubber band t19 installed in the recessed portion t18 in the hard cylindrical roller t2 may contact the hollow rubber roller t1, depending on the cross angle between the pair of twisting rollers. Thus, narrow circumferential grooves t20 may be formed along the circumferential direction to increase twisting efficiency.

Furthermore, with the constant assembly pitch of the twisting rollers maintained, the thickness of the roller band t19 can be varied as required to vary the amount of protrusion of the rubber band t19 from the cylindrical middle regions t2', in order to adjust twisting efficiency.

Due to the configuration described above, the present invention has the following effects.

Twisting efficiency is improved compared to the conventional twisting apparatus in which the twisting rollers both comprise hollow rubber rollers. Thus, by applying the present invention to a spinning apparatus for manufacturing spun yarn from a fiber set, the spinning speed of the spun yarn can be increased and the spinning range extended.

Since the cross angle between the twisting rollers can be distinctly varied compared to the conventional twisting rollers both comprising hollow rubber rollers, the present invention can deal with various fiber sets of different materials, fiber lengths, or thicknesses and can cope with various spinning conditions.

The contact pressure on the contact region is further stabilized to enable the fiber set to be stably twisted. Thus, by applying the present invention to a spinning apparatus for manufacturing spun yarn from a fiber set, the spinning speed of the spun yarn Y can be increased and spun yarn of stable quality can be manufactured.

Since one of the twisting rollers is a hard cylindrical roller, it minimizes the need for roller replacements resulting from abrasion. The hollow rubber roller is also less likely to become abraded than with conventional twisting rollers both comprising hollow rubber rollers.

The present invention is configured to enable the thickness of the rubber band to be varied, thereby enabling twisting efficiency to be adjusted as required.

The circumferential grooves formed in the cylindrical middle regions located on the respective sides of the rubber band in the hard cylindrical roller can increase twisting efficiency.

Next, another embodiment of the cylindrical roller t2 is described with reference to FIGS. 7 and 8.

According to this embodiment, one of the pair of twisting rollers is a hollow rubber roller, while the other is a hard, abrasion-resistant cylindrical roller. Second, narrow grooves are formed in the circumferential surface of a hard, abrasion-resistant cylinder along the circumferential direction. Third, the cylinder is formed of ceramics.

Figure 7:
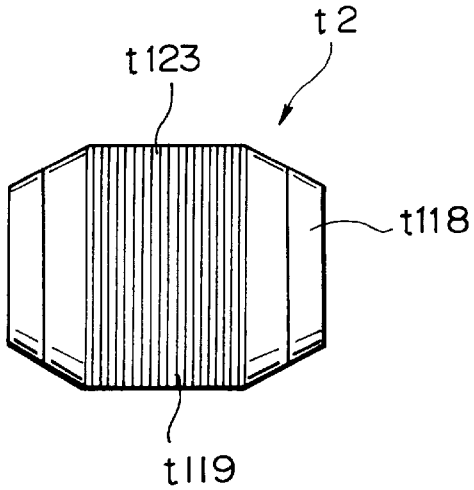
FIG. 7 is a front view of yet another embodiment of the other twisting roller constituting the twisting apparatus according to the present invention.
Figure 8:
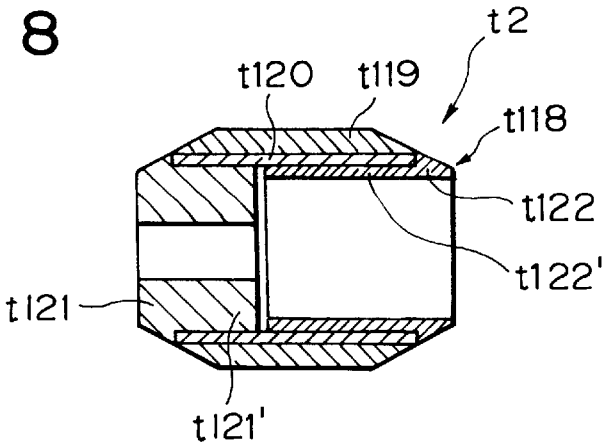
FIG. 8 is a vertical sectional view of the twisting roller shown in FIG. 7.

FIGS. 7 and 8 show the twisting roller t2. The twisting roller t2 comprises a cylindrical roller t118 on which a hard, abrasion-resistant cylinder t119 formed of ceramics or a metal, such as iron, is installed. The cylindrical roller t118 is composed of a metallic cylindrical sleeve t120 on which the hard cylinder t119 is installed and collar-shaped bodies t121 and t122 having cylindrical portions t121' and t122" installed in a cylindrical sleeve t120 in such a way as to sandwich the cylindrical sleeve t120 from both ends. In addition, narrow grooves t123 are formed approximately throughout the circumferential surface of the hard, abrasion-resistant cylinder t119 in the circumferential direction. Although the above embodiment shows an example in which the cylindrical roller t118 is formed of three pieces including the cylindrical sleeve t120 and the collars t121 and t122, the cylindrical sleeve t120 and the collars t121 and t122 may be integrally formed as required. A support and a drive means for the hard cylindrical roller t118 are substantially the same as those for the above hollow rubber roller t1, so a description of these items is omitted.

According to this embodiment, one of the twisting rollers t1 and t2, the rotating shafts of which cross each other and which are disposed in such a way as to form a contact region in the large-diameter regions located in their approximate center, comprises the hollow rubber roller t1, and the other twisting roller comprises the hard cylindrical roller t118 on which a hard, abrasion-resistant cylinder t119 formed of ceramics or a metal, such as iron, is installed. The twisting efficiency of the twisting apparatus T can be adjusted by varying the cross angle between the twisting rollers t1 and t2 or the thickness of the hollow rubber roller t1. The cylinder t119 may be formed of a metal, such as iron, or of a hard synthetic resin, on which abrasion-resistant plating or coating may be applied.

By combining together the hollow rubber roller t1 and the cylindrical roller t118 on which the hard, abrasion-resistant cylinder t119 is installed in order to constitute the twisting apparatus T, twisting efficiency is improved compared to the conventional twisting apparatus in which both twisting rollers are hollow rubber rollers. Thus, by applying the present invention to the above spinning apparatus for manufacturing the spun yarn Y from the fiber set S, the spinning speed of the spun yarn Y can be increased and the spinning range extended.

In addition, since one of the twisting rollers is the cylindrical roller t118 on which the hard, abrasion-resistant cylinder t119 is installed, spinning can be achieved even if the cross angle between the twisting rollers t1 and t2 is varied distinctly, thereby extending the range of spinning conditions available compared to use of conventional twisting rollers both comprising hollow rubber rollers. Accordingly, the present invention can deal easily with various fiber sets S of different materials, fiber lengths, or thicknesses and can also cope with various spinning conditions.

Furthermore, since one of the twisting rollers is a cylindrical roller t118 on which the hard, abrasion-resistant cylinder t119 is installed, the contact pressure on the contact region is further stabilized to enable the fiber set S to be stably twisted. Thus, by applying the present invention to the above spinning apparatus for manufacturing the spun yarn Y from the fiber set S, the spinning speed of the spun yarn Y can be increased and spun yarn of stable quality can be manufactured.

Furthermore, since the hard, abrasion-resistant cylinder t119 is installed on the cylindrical roller t118 constituting one of the twisting rollers, it minimizes the need for roller replacement resulting from abrasion. In addition, the present invention reduces slippage and thus the abrasion of the hollow rubber roller t1, compared to the conventional twisting rollers both comprising hollow rubber rollers.

The narrow grooves t123 are formed in the circumferential surface of the hard, abrasion-resistant cylinder t119 in the circumferential direction to reliably grip the fiber set S between the cylinder and the hollow rubber roller t1. When the fiber set is gripped for twisting, this configuration prevents the fiber set S from escaping in order to provide stable twisting efficiency.

Due to the configuration described above, the present invention has the following effects.

Twisting efficiency is improved compared to conventional twisting rollers both comprising hollow rubber rollers. Thus, by applying the present invention to a spinning apparatus for manufacturing spun yarn from a fiber set, the spinning speed of the spun yarn can be increased and the spinning range extended.

Since the cross angle between the twisting rollers can be distinctly varied compared to the conventional twisting rollers both comprising hollow rubber rollers, the present invention can deal with various fiber sets of different materials, fiber lengths, or thicknesses and can cope with various spinning conditions.

The contact pressure on the contact region is further stabilized to enable the fiber set to be twisted stably. Thus, by applying the present invention to a spinning apparatus for manufacturing spun yarn from a fiber set, the spinning speed of the spun yarn can be increased and spun yarn of stable quality manufactured.

Furthermore, since the hard, abrasion-resistant cylinder is installed on the cylindrical roller constituting one of the twisting rollers, it minimizes the needs for roller replacements resulting from abrasion. In addition, the hollow roller is less likely to abrade than with use of conventional twisting rollers both comprising hollow rubber rollers. In particular, by forming the cylinder of ceramics, abrasion resistance is improved to minimize the likelihood of abrasion of the hollow rubber roller, thereby reducing the need for maintenance and management of the twisting apparatus.

The narrow grooves are formed in the circumferential surface of the hard, abrasion-resistant cylinder in the circumferential direction, thereby providing stable twisting efficiency.

What is claimed is:

1. A twisting apparatus for twisting a fiber set including a pair of twisting rollers mounted for rotation on crossed shafts, said rollers having mutually cooperating circumferential contact regions for gripping and twisting said fiber set wherein one of said pair of twisting rollers contains a contact region defined by a hollow rubber roller and the other of said pair of twisting rollers contains a contact region defined by a hard, substantially solid cylindrical base and a rubber band circumferentially surrounding said base for engagement with the contact region of said one twisting roller.

2. A twisting apparatus according to claim 1 wherein said solid cylindrical base of said other twisting roller contains means for detachably mounting rubber bands of various thicknesses.

3. A twisting apparatus according to claim 1 or claim 2 including circumferential grooves formed in cylindrical middle regions of said other twisting roller on the respective sides of the rubber band installed thereon.

4. A twisting apparatus for twisting a fiber set including a pair of twisting rollers mounted for rotation on crossed shafts, said rollers having mutually cooperating circumferential contact regions for gripping and twisting said fiber set wherein one of said pair of twisting rollers contains a contact region defined by a hollow rubber roller and the other of said pair of twisting rollers comprises a composite body formed of substantially rigid members and a contact region defined by a hard, abrasion-resistant cylinder supported by said rigid members.

5. A twisting apparatus according to claim 4 characterized in that a narrow groove is formed in the circumferential surface of the hard, abrasion-resistant cylinder along its circumferential direction.

6. A twisting apparatus according to claim 4 or claim 5 characterized in that the cylinder is formed of ceramic materials.

* * * * *